US009336974B2

(12) United States Patent
Kotsuji et al.

(10) Patent No.: US 9,336,974 B2
(45) Date of Patent: May 10, 2016

(54) GAS CIRCUIT BREAKER

(71) Applicant: Hitachi, Ltd., Chiyoda-ku, Tokyo (JP)

(72) Inventors: Hideyuki Kotsuji, Tokyo (JP); Hajime Urai, Tokyo (JP); Makoto Koizumi, Tokyo (JP); Makoto Hirose, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/414,492

(22) PCT Filed: Oct. 9, 2013

(86) PCT No.: PCT/JP2013/077417
§ 371 (c)(1),
(2) Date: Jan. 13, 2015

(87) PCT Pub. No.: WO2014/069195
PCT Pub. Date: May 8, 2014

(65) Prior Publication Data

US 2015/0170858 A1 Jun. 18, 2015

(30) Foreign Application Priority Data

Oct. 31, 2012 (JP) ..... 2012-239737

(51) Int. Cl.

| | |
|---|---|
| ***H01H 33/91*** | (2006.01) |
| ***H01H 33/88*** | (2006.01) |
| ***H01H 33/78*** | (2006.01) |
| *H01H 33/74* | (2006.01) |
| *H01H 33/02* | (2006.01) |

(52) U.S. Cl.
CPC ..... *H01H 33/88* (2013.01); *H01H 33/78* (2013.01); *H01H 33/91* (2013.01); *H01H 33/74* (2013.01); *H01H 2033/028* (2013.01)

(58) Field of Classification Search
CPC ..... H01H 73/18; H01H 9/34
See application file for complete search history.

(56) References Cited

U.S. PATENT DOCUMENTS 5,793,597 A * 8/1998 Mizufune ..... H01H 33/7015 218/52
5,850,065 A 12/1998 Yaginuma et al.
(Continued)

FOREIGN PATENT DOCUMENTS

JP 8-115642 A 5/1996
JP 8-203396 A 8/1996
(Continued)

OTHER PUBLICATIONS

International Search Report dated Nov. 5, 2013 with English translation (five (5) pages).

*Primary Examiner* — Truc Nguyen
(74) *Attorney, Agent, or Firm* — Crowell & Moring LLP

(57) ABSTRACT

A pair of arcing contacts 3 and 5 facing each other are placed in a tank 1 to perform opening and closing operation, and a puffer cylinder 7 is coaxially provided on the circumference of one arcing contact 5. A puffer chamber 9 is comprised of the puffer cylinder 7, a fixed piston 6, and a hollow rod 8. An insulating nozzle 4 forming a space communicating with the puffer chamber 9 is provided. An exhaust tube 2 for exhausting and cooling hot gas discharged from an arc produced in the insulating nozzle 4 is provided on the circumference of the other arcing contact 3. A structure 11 for temporarily reducing the flow path area is provided on the inner circumferential surface at short of the end portion of the exhaust tube 2.

12 Claims, 4 Drawing Sheets

(56) References Cited

U.S. PATENT DOCUMENTS

| | | | | |
|---|---|---|---|---|
| 6,660,954 | B2 * | 12/2003 | Iwabuchi | H01H 33/91 218/51 |
| 7,498,540 | B2 * | 3/2009 | Yoshitomo | H01H 33/53 218/154 |
| 2007/0158310 | A1 * | 7/2007 | Grieshaber | H01H 33/98 218/13 |
| 2008/0203061 | A1 * | 8/2008 | Yoshida | H01H 33/905 218/61 |
| 2013/0161289 | A1 * | 6/2013 | Horinouchi | H01H 33/703 218/47 |
| 2013/0168357 | A1 * | 7/2013 | Yaginuma | H01H 33/08 218/57 |

FOREIGN PATENT DOCUMENTS

| | | | |
|---|---|---|---|
| JP | 9-231885 | A | 9/1997 |
| JP | 9-306308 | A | 11/1997 |
| JP | 10-275543 | A | 10/1998 |
| JP | 2007-179830 | A | 7/2007 |
| JP | 2012-129091 | A | 7/2012 |

* cited by examiner

GAS CIRCUIT BREAKER

TECHNICAL FIELD

The present invention relates to circuit breakers and in particular to a gas circuit breaker in which when a current is interrupted, insulating gas is blown to extinguish an arc.

BACKGROUND ART

In recent years, power systems have been increased in voltage and current and the capacities of gas circuit breakers have been increased to obtain required interrupting performance. Meanwhile, downsizing by the optimization of interrupting portion structures and exhaust/shield structures has also been pursued for the purpose of cost reduction.

FIG. 2 illustrates the general structure of a gas circuit breaker. The gas circuit breaker is housed in a tank 1 filled with insulating gas. Under normal conditions, a fixed arching contact 3 on the electrode side and a moving arcing contact 5 on the moving side are electrically connected with each other. When an opening operation is instructed at the time of an accident, the moving side is actuated by an actuator through an insulating rod 10. As a result, the fixed arching contact 3 on the electrode side and the moving arcing contact 5 on the moving side are caused to transition into a physically open state.

Even after the contacts are opened, a current flows and an arc is produced between the fixed arching contact 3 and the moving arcing contact 5. The gas circuit breaker blows high-pressure insulating gas on the arc to extinguish the arc. For the purpose, when the moving side is actuated, the insulating gas in a puffer chamber 9 is compressed by a fixed piston 6. Then the gas is blown on the arc and the arc is extinguished.

The hot gas produced during gas blowing is high in temperature and low in density and is thus low in dielectric strength. For the prevention of degradation in dielectric strength between electrodes, after success is achieved in arc-extinguishing, it is necessary to swiftly discharge the hot gas from between the electrodes through an exhaust tube 2.

The roles of the exhaust tube are to swiftly discharge produced hot gas without retaining the hot gas and to efficiently cool the hot gas.

A description will be given to the mechanism of the occurrence of electrical breakdown between the exhaust tube 2 and the tank 1 with reference to FIG. 2. When gas is insufficiently cooled and hot gas high in temperature and low in dielectric strength arrives at the high electrical field portion at an end of the exhaust tube with the density of the gas remaining low, the following takes place: the dielectric strength between the exhaust tube 2 and the tank 1 is degraded. As a result, a fault (earthing) occurs to cause electrical breakdown between the exhaust tube 2 and the tank 1.

To cope with earthing faults, various means are taken. For example, the gas tank diameter is extended to obtain high dielectric strength due to electric field relaxation between the exhaust tube and the tank, or the exhaust tube is expanded to enhance hot gas cooling performance.

In addition, a through hole is provided in the exhaust tube to draw high-density, low-temperature gas into the exhaust tube through the through hole utilizing the pressure difference between inside and outside the exhaust tube, or a spiral groove structure is provided in the inner circumferential surface of the exhaust tube to prevent low-density insulating gas from being brought into contact with the inner circumferential surface in proximity to an end of the exhaust tube. Degradation in dielectric strength is thereby prevented (Patent Literature 1).

CITATION LIST

Patent Literature

PTL 1: Japanese Patent Application Laid-Open No. Hei 8 (1996)-203396

SUMMARY OF INVENTION

Technical Problem

Dielectric strength enhancing means, such as electric field relaxation by the extension of gas tank diameter and the enhancement of hot gas cooling performance by the expansion of an exhaust tube, can lead to increase in the size of a circuit breaker. A dielectric strength enhancing means by machining an exhaust tube leads to increase in circuit breaker manufacturing cost depending on the type of machining.

It is an object of the present invention to provide a gas circuit breaker whose high dielectric strength can be enhanced by taking the following measure: placing a structure or adding a part on the inner circumferential surface before an end portion of an exhaust tube for narrowing the flow path.

Solution to Problem

To achieve the above object, a gas circuit breaker of the present invention includes: a pair of arcing contacts oppositely placed in a tank so as to enable opening and closing actions; a puffer cylinder coaxially provided on the circumference of one of the arcing contacts; a puffer chamber including the puffer cylinder, a fixed piston, and a hollow rod; an insulating nozzle forming a space communicating with the puffer chamber; and an exhaust tube provided on the circumference of the other of the arcing contacts for exhausting and cooling hot gas discharged from an arc produced in the insulating nozzle. A structure is provided on the inner circumferential surface before the end portion of the exhaust tube to temporarily reduce the flow path area.

Advantageous Effects of Invention

In the present invention, such a structure as to temporarily narrow the flow path is placed in the exhaust tube for discharging hot gas produced when a current is interrupted. This varies the gas flow rate to separate gas from the inner wall of the exhaust tube and prevents the hot gas with degraded dielectric strength from arriving at a high electrical field portion at the end of the exhaust tube. Since the exhaust tube does not require complicated machining, the present invention can be inexpensively configured.

DESCRIPTION OF EMBODIMENTS

Hereafter, a description will be given to embodiments of the present invention. Described below are just examples. The following description is not intended to limit the scope of the present invention to the following concrete embodiments. The present invention can be embodied in various modes without departing from the description in CLAIMS, needless to add.

<First Embodiment>

Figure 3:
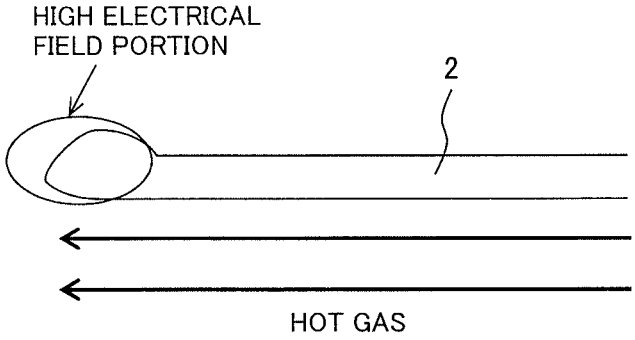
FIG. 3 is a sectional view of a high electrical field portion at an end of the exhaust tube of a conventional gas circuit breaker and an explanatory drawing of a gas flow.

A description will be given to a first embodiment with reference to FIG. 1, FIG. 3, and FIG. 4. Though not shown in the drawings, the circuit breaker in this embodiment is connected with an actuator through an insulating rod 10. The entire circuit breaker is placed in a tank 1 filled with $SF_6$ insulating gas.

Figure 1:
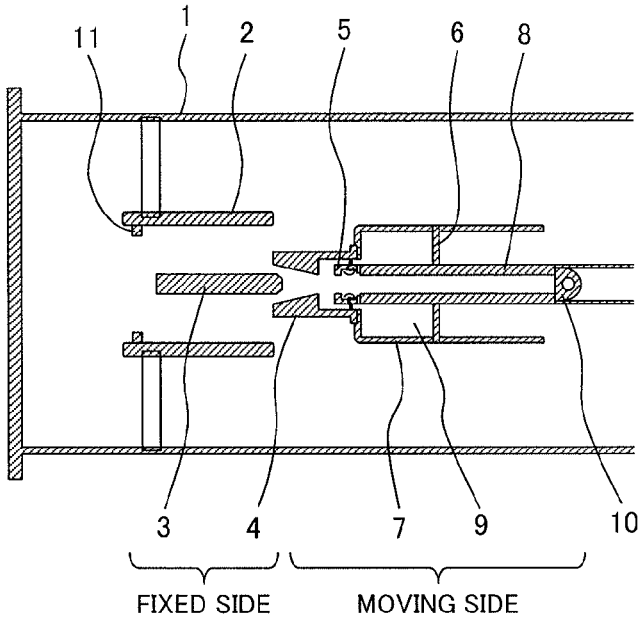
FIG. 1 is a sectional view of a gas circuit breaker in a first embodiment.
Figure 2:
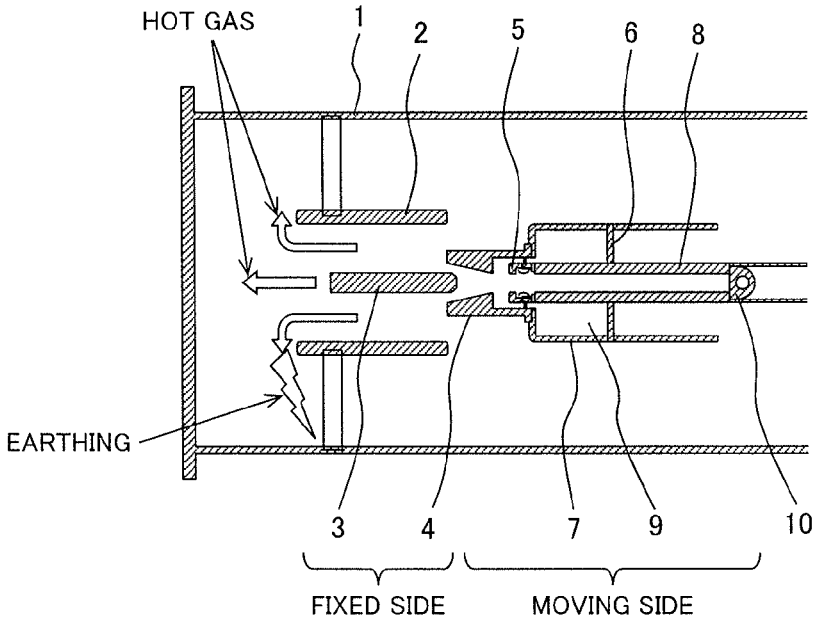
FIG. 2 is an explanatory drawing of a gas flow in the exhaust tube of a conventional gas circuit breaker and an earthing phenomenon occurring there.

As shown in FIG. 1, the circuit breaker in this embodiment is roughly configured of: a fixed arching contact 3 and a moving arcing contact 5; a puffer cylinder 7; a puffer chamber 9 comprised of the puffer cylinder 7 and a fixed piston 6; an insulating nozzle 4; and an exhaust tube 2 for exhausting and cooling hot gas discharged from the insulating nozzle 4.

The circuit breaker is configured of: the fixed arching contact 3 and the exhaust tube 2 placed on the outer circumferential side thereof; the moving arcing contact 5 brought into contact with the fixed arching contact 3 in the energized state (closed position); and the puffer cylinder 7 brought into contact with the exhaust tube 2 in the energized state (closed position). The fixed arching contact 3 and the moving arcing contact 5 and the exhaust tube 2 and the puffer cylinder 7 are respectively electrically connected with each other.

The puffer chamber 9 is formed of: the puffer cylinder 7; a hollow rod 8 that is coaxially placed on the inner circumference of the puffer cylinder 7 and is hollow therein and into the hollow portion of which insulating gas flows; and the fixed piston 6 that slides in the space formed between the puffer cylinder 7 and the hollow rod 8.

The fixed piston 6 is fixed on a mounting seat provided on the inner circumferential surface of the tank. The pressure of insulating gas, to be blown on an arc, in the puffer chamber is formed by the puffer cylinder 7 moving relative to the fixed piston 6. A more detailed description will be given. The driving force of the actuator, not shown, is transmitted from the insulating rod 10 connected with the actuator to the puffer cylinder 7 through the hollow rod 8. The puffer cylinder 7 is thereby driven to compress the insulating gas in the puffer chamber 9.

The high-pressure insulating gas compressed in the puffer chamber 9 is blown on an arc produced between the fixed arching contact 3 and the moving arcing contact 5. The high-temperature hot gas produced after the insulating gas is blown on the arc goes through the insulating nozzle 4 and the interior of the exhaust tube 2 and is cooled and discharged from the end on the fixed side into the tank 1.

Figure 4:
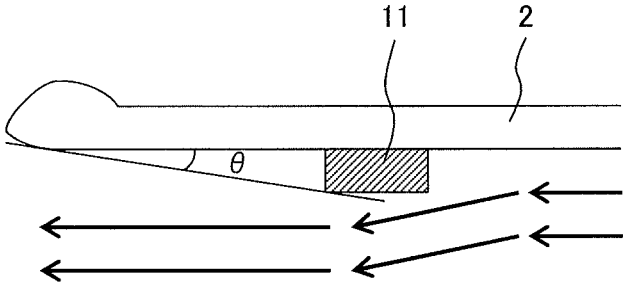
FIG. 4 is an enlarged view of a part of the exhaust tube in the first embodiment and an explanatory drawing of a gas flow.

As shown in the enlarged view of a part of the exhaust tube in FIG. 4, a structure 11 for temporarily reducing the gas flow path area of the exhaust tube is installed in the exhaust tube. In case of ordinary exhaust tube structures, as shown in FIG. 3, the discharged hot gas is discharged along the inner wall of the exhaust tube. When the structure 11 is installed on the inner wall of the end of the exhaust tube as shown in FIG. 4, the flow path cross sectional area is reduced in the position of the structure 11. This causes changes in flow rate and pressure and separates the hot gas from the exhaust tube inner wall and the hot gas is exhausted from the exhaust tube.

For this reason, the discharged hot gas does not arrive at the high electrical field portion at the end of the exhaust tube and is discharged into the tank. In the present invention, the structure for temporarily narrowing the flow path is placed on the inner circumferential surface of the exhaust tube before the high electrical field portion at the end portion of the exhaust tube. As a result, the object of the enhancement of high dielectric strength is achieved without increasing the size of the circuit breaker or using complicated machining.

In the present invention, the structure 11 for reducing the flow path area is placed on the inner circumferential surface, avoiding the high electrical field portion in proximity to the end portion of the exhaust tube. As a result, it is possible to separate the hot gas from the exhaust tube inner wall by changes in flow rate and pressure and to prevent the hot gas from arriving at the high electrical field portion.

However, if the angle θ between the end portion of the exhaust tube and the structure, shown in FIG. 4, is too small, a problem will arise. After the hot gas is temporarily separated from the exhaust tube inner wall, the hot gas flows along the exhaust tube inner wall again. As a result, the high electrical field portion at the end portion of the exhaust tube is exposed to the hot gas with degraded dielectric strength.

Changes in pressure and flow rate become greater with increase in the angle θ and the separation phenomenon is made more prone to occur. When the structure 11 is placed in a position where, for example, the angle $\theta=10$ degrees or more can be ensured, sufficient changes in pressure and flow rate can be caused; and thus it is possible to prevent the arrival of the hot gas at the end portion of the exhaust tube.

In the present invention, the structure 11 for reducing the flow path area may be fabricated integrally with the exhaust tube. Also, the structure 11 may be formed by securing a ring-shaped structure on a simply cylindrical exhaust tube shape by welding, screw, or the like.

In this embodiment, $SF_6$ is used for the insulating gas but the type of the insulating gas is not limited to $SF_6$. Any other insulating gas, such as dry air, nitrogen gas, or the like, may be used, needless to add.

<Second Embodiment>

Figure 5:
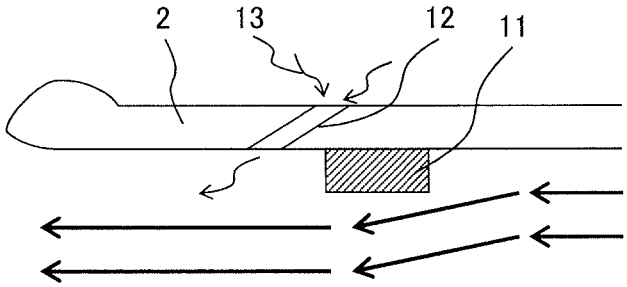
FIG. 5 is a sectional view showing a shape in which a through hole is provided in the exhaust tube in a second embodiment and an explanatory drawing illustrating how a gas flow is drawn in through the through hole.

Hereafter, a description will be given to a second embodiment with reference to FIG. 5. The same items as in the first embodiment will be marked with the same reference signs and a description thereof will be omitted.

In the first embodiment, the structure 11 for narrowing the flow path is placed in the exhaust tube to obtain an exhaust tube shape for the enhancement of dielectric strength. In this embodiment, in addition, a through hole 12 penetrating the exhaust tube and connecting the interior and exterior thereof is provided in a position where the narrowed flow path is widened again.

The flow rate and the pressure are varied before and after the cross sectional area of the flow path for exhausting hot gas is reduced by the structure 11 placed on the exhaust tube inner wall. Also when the through hole 12 is provided without the structure 11, the pressure in the exhaust tube in which hot gas is flowing is lower than the external pressure. Therefore, the inflow of low-temperature gas external to the exhaust tube is caused through the through hole 12 and the hot gas is cooled.

In this embodiment, the through hole 12 is provided in a position where the flow path narrowed by the structure 11 provided in the exhaust tube is widened again. As a result, a larger pressure difference is produced as compared with cases where the structure 11 is not provided. Thus external cooling gas is more efficiently taken in to cool hot gas and prevent degradation in dielectric strength.

<Third Embodiment>

Hereafter, a description will be given to a third embodiment with reference to FIGS. 6 and 7. The same items as in the first and second embodiments will be marked with the same reference signs and a description thereof will be omitted.

In the first and second embodiments, the structure 11 for narrowing the flow path is placed in the exhaust tube. In this embodiment, the structure 11 is tapered so as to narrow the flow path along the direction of the flow.

In the first embodiment, the structure 11 is placed in the exhaust tube and the speed and pressure of hot gas are varied by narrowing the flow path. Arrival of the hot gas with degraded dielectric strength at the end of the exhaust tube is thereby prevented. However, when the flow path cross sectional area is reduced by narrowing the gas flow path, the flow path resistance is increased and degradation in gas exhausting performance is incurred. When the exhaust performance is degraded, gas with degraded dielectric strength is retained between the electrodes and an arc can be ignited again between the electrodes.

Figure 6:
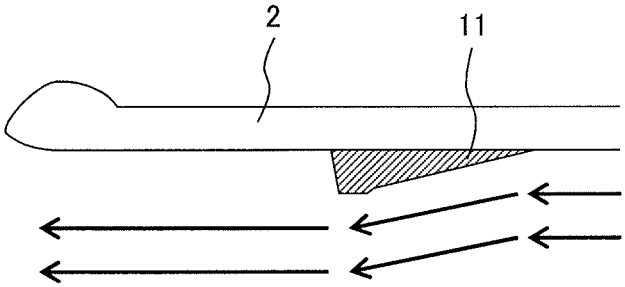
FIG. 6 is a schematic diagram illustrating a different shape of a structure in a third embodiment.
Figure 7:
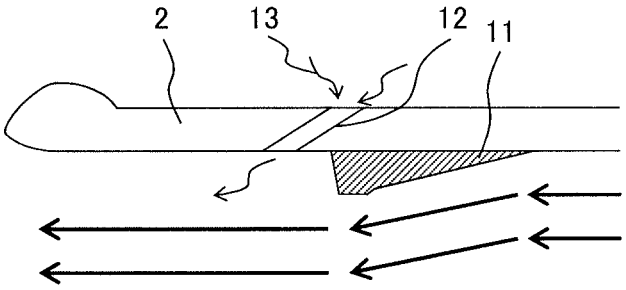
FIG. 7 is a sectional view of the exhaust tube structure in the third embodiment to which a through hole is added.

To cope with this, the structure 11 is tapered as illustrated in FIG. 6. This makes it possible to reduce increase in the gas flow path resistance and to efficiently exhaust gas from the exhaust tube to prevent the degradation in dielectric strength between the electrodes. In addition, the hot gas cooling function described in relation to the second embodiment is obtained by providing a through hole between the end portion of the exhaust tube and the structure as illustrated in FIG. 7.

<Fourth Embodiment>

In the above-mentioned embodiments, the fixed arching contact 3 is fixed. The present invention can also be applied to a so-called dual motion circuit breaker in which the arcing contact opposed to the moving arcing contact 5 on the moving side is relatively movable.

Figure 8:
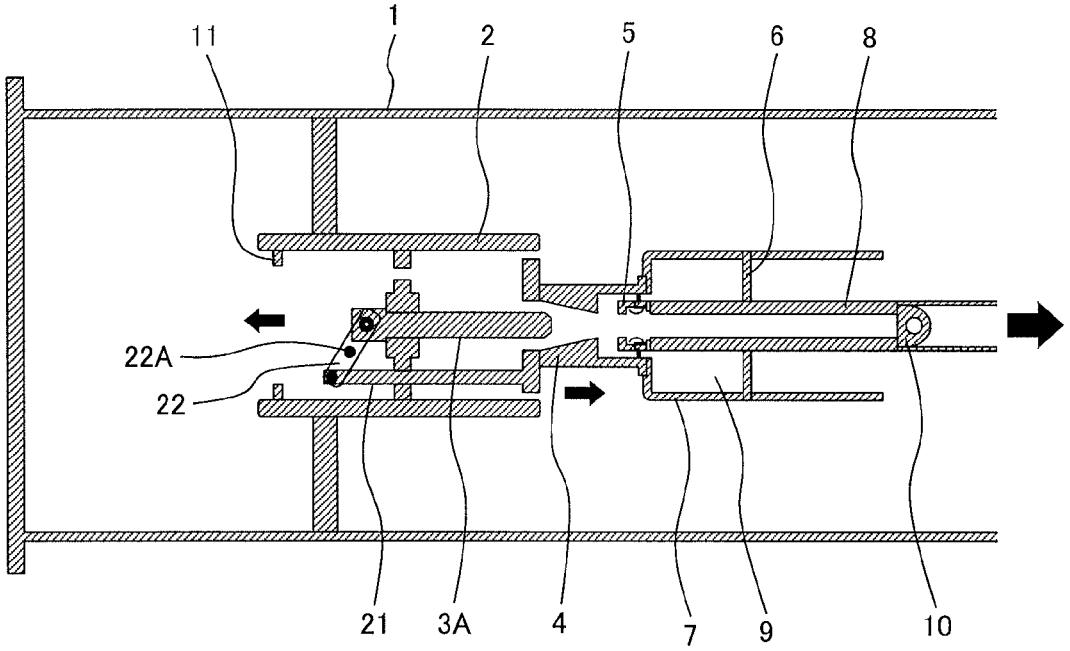
FIG. 8 is a schematic diagram of the present invention applied to a gas circuit breaker of a dual motion type.

Hereafter, a description will be given to an embodiment in which the present invention is applied to a dual motion circuit breaker with reference to FIG. 8. The tip of the insulating nozzle 4 is fixed at one end of a coupling rod 21 and the other end of the coupling rod 21 and one end of a coupling lever 22 are rotatably coupled with each other. The substantially central part of the coupling lever 22 is rotatably secured on the inner circumferential surface of the exhaust tube 2 on a support shaft 22A. The other end of the coupling lever 22 and the end portion of an arcing contact 3A are rotatably coupled with each other. With this configuration, when the moving side starts opening action, the arcing contact 3A moves in the direction in which the arcing contact 3A is brought away from the moving side.

The structure 11 and through hole 12 described in relation to each of the above embodiments are placed on the inner circumferential surface in proximity to the end of the exhaust tube 2 of such a dual motion circuit breaker. As a result, the same effect as in the above-mentioned embodiments can be obtained.

When a metal material or a resin material high in coefficient of thermal conductivity is used for the structure 11 of the present invention, hot gas can be more effectively cooled. When the structure 11 is formed of a resin material, ablation is caused in the structure by hot gas. The hot gas can be cooled by heat of evaporation produced at this time.

REFERENCE SIGNS LIST

1 . . . tank
2 . . . exhaust tube
3 . . . fixed arching contact
3A . . . arcing contact
4 . . . insulating nozzle
5 . . . moving arcing contact
6 . . . fixed piston
7 . . . puffer cylinder
8 . . . hollow rod
9 . . . puffer chamber
10 . . . insulating rod
11 . . . structure
12 . . . through hole
13 . . . low-temperature gas
21 . . . coupling rod
22 . . . coupling lever
22A . . . support shaft

The invention claimed is:

1. A gas circuit breaker comprising:

a pair of arcing contacts facing each other in a tank to perform opening and closing operation;

a puffer cylinder coaxially provided on the circumference of one of the arcing contacts;

a puffer chamber being composed of the puffer cylinder, a fixed piston, and a hollow rod;

an insulating nozzle forming a space communicating with the puffer chamber; and an exhaust tube provided on the circumference of the other arcing contact to exhaust and cool hot gas, the hot gas being discharged from an arc being produced in the insulating nozzle, wherein the exhaust tube has a structure for temporarily reducing the flow path area, the structure being provided on the inner circumferential surface at short of an end of the exhaust tube, the structure being located between an end of the other arcing contact and the end of the exhaust tube.

2. The gas circuit breaker according to claim 1, wherein the structure is formed in a tapered shape so as to narrow the flow path toward the gas exhausting direction.

3. The gas circuit breaker according to claim 1, further comprising a through hole penetrating the exhaust tube and connecting the interior and exterior of the exhaust tube, the through hole being provided in a position between the structure and the end of the exhaust tube where the flow path area is widened again.

4. The gas circuit breaker according to claim 2, further comprising a through hole penetrating the exhaust tube and connecting the interior and exterior of the exhaust tube, the through hole being provided in a position between the structure and the end of the exhaust tube where the flow path area is widened again.

5. The gas circuit breaker according to claim 1, wherein the structure is detachably fit in the inner circumferential portion at short of the end of the exhaust tube.

6. The gas circuit breaker according to claim 2, wherein the structure is detachably fit in the inner circumferential portion at short of the end of the exhaust tube.

7. The gas circuit breaker according to claim 3, wherein the structure is detachably fit in the inner circumferential portion at short of the end of the exhaust tube.

8. The gas circuit breaker according to claim 3, wherein the through hole is provided at an angle through the exhaust tube in a direction of the flow path.

9. The gas circuit breaker according to claim 4, wherein the through hole is provided at an angle through the exhaust tube in a direction of the flow path.

10. The gas circuit breaker according to claim 3, wherein the through hole is disposed adjacent to the structure and a portion of the through hole is in vertical alignment with the structure.

11. The gas circuit breaker according to claim 4, wherein the through hole is disposed adjacent to the structure and a portion of the through hole is in vertical alignment with the structure.

12. The gas circuit breaker according to claim 1, wherein an angle formed between an inner surface of the end of the exhaust tube and an inner surface of the structure is 10° or more.

* * * * *